US007124732B2

(12) United States Patent
Sugamuna et al.

(10) Patent No.: US 7,124,732 B2
(45) Date of Patent: Oct. 24, 2006

(54) LUBRICATING APPARATUS FOR AN INTERNAL COMBUSTION ENGINE

(75) Inventors: Noboru Sugamuna, Shizuoka-ken (JP); Shigeaki Miyata, Shizuoka-ken (JP); Jun Miura, Shizuoka-ken (JP); Hiroko Wada, Shizuoka-ken (JP)

(73) Assignees: Ihara Mfg. Co. Ltd., Shizuoka (JP); Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/001,287

(22) Filed: Dec. 1, 2004

(65) Prior Publication Data

US 2005/0126532 A1 Jun. 16, 2005

(30) Foreign Application Priority Data

Dec. 1, 2003 (JP) ..... 2003-401113

(51) Int. Cl.
*F01M 1/00* (2006.01)

(52) U.S. Cl. ..... 123/196 R

(58) Field of Classification Search ..... 123/196 R
See application file for complete search history.

(56) References Cited

U.S. PATENT DOCUMENTS 6,732,700 B1 * 5/2004 Suganuma ..... 123/196 R
6,823,828 B1 * 11/2004 Nishi et al. ..... 123/196 R
2002/0078917 A1 * 6/2002 Suganuma ..... 123/196 R
2003/0116115 A1 * 6/2003 Nishi et al. ..... 123/196 R
2004/0040531 A1 * 3/2004 Yamamoto ..... 123/196 R

FOREIGN PATENT DOCUMENTS

JP 2001-073731 3/2001

* cited by examiner

*Primary Examiner*—Noah P. Kamen
*Assistant Examiner*—Jason Benton
(74) *Attorney, Agent, or Firm*—Knobbe, Martens, Olson & Bear, LLP

(57) ABSTRACT

A lubricating apparatus for an internal combustion engine includes an oil pump 12 comprising a feed pump 13 and scavenging pumps 14 and 15. Then oil pump 12 and an oil tank 16 are arranged at the outside of the internal combustion engine 9. A pump shaft for the pumps 13, 14 and 15 can be arranged in a same direction as that of a crank shaft of the engine 9. The feed pump 13 and two scavenging pumps 14 and 15 are arranged in serial order with the feed pump being farthest from the engine 9. A check valve 24 can be arranged in a passage of the discharge side of the feed pump 13. A relief valve 23 can be arranged between a passage of the discharge side of the feed pump 13 and a passage of the intake side of the scavenging pump 14.

6 Claims, 8 Drawing Sheets

LUBRICATING APPARATUS FOR AN INTERNAL COMBUSTION ENGINE

The present application is based on and claims priority to Japanese Patent Application No. 2003-401113, filed Dec. 1, 2003, the entire contents of which is hereby expressly incorporated by reference.

BACKGROUND OF THE INVENTIONS

1. Field of the Inventions

The present inventions relate to a lubricating apparatus for an internal combustion engine comprising a feed pump and scavenging pumps.

2. Description of Background Art

In a wetsump type lubricating apparatus, lubricating oil accumulated in an oil pan arranged at a lower part of an internal combustion engine is directly fed to parts required to be lubricated in the engine. In some engines, a drysump type lubricating system is used in place of the wetsump type apparatus.

In a drysump type apparatus, an oil reservoir is provided in addition to an oil pan for collecting the lubricating oil from the oil pan. The lubricating oil accumulated in the oil reservoir is fed to an oil tank by scavenging pump(s). The lubricating oil can remain in the oil tank for a time. Then the lubricating oil is fed by a feed pump from the oil tank to parts of engine required to be lubricated.

In a vehicle such as an all terrain vehicle designed for traveling off-road or on a steeply sloped road, it is desirable that the vehicle has a sufficient ground clearance for off-road use, as well as a low center of gravity. Accordingly, an oil pan, such as that commonly used in wetsump systems, is undesirable because the large undulations on the bottom surface of such an oil pan interferes with ground clearance and/or requires the engine to be mounted higher, thereby raising the center of gravity. If a drysump type system is used, it remains difficult to configure the oil reservoir to operate properly even when the body of vehicle is inclined.

One example of a prior art lubricating apparatus for an internal combustion engine which can help to alleviate these problems is shown in FIGS. 7 and 8. As shown in FIG. 7, an oil pump unit 50 comprises a feed pump 51, a main scavenging pump 52 and a sub-scavenging pump 53 and is arranged between a front case 60*a* and a rear case 60*b* of a crank case 60. Rotors 54, 55 and 56 of these pumps 51, 52 and 53 are mounted on a common driving shaft 63 so as to be driven integrally therewith.

Oil reservoirs 57 and 58 are arranged at the bottom of the crank case 60 and are separated in a fore and aft direction by a partition wall 59. The main scavenging pump 52 and the sub-scavenging pump 53 separately draw oil from the oil reservoirs 57 and 58, respectively. The oil reservoir 57 is arranged substantially at a middle of the bottom of the crank case 60 which is a position where most of the oil tends to collect when the vehicle body is in a horizontal position. On the other hand, the oil reservoir 58 is arranged at a position shifted rearwardly relative to the reservoir 57 and extends in the right and left directions so that the oil can easily move even when the vehicle body is inclined toward the fore and aft directions or the right and left directions.

As shown in FIG. 8, a relief valve 61 is arranged between a passage of the discharge side of the feed pump 51 and a passage of the discharge side of the main scavenging pump 52 and the sub-scavenging pump 53. As such, the relief valve 61 can open and relieve surplus oil when a pressure in the passage of the discharge side of the feed pump 51 exceeds a predetermined relief pressure. The surplus oil is then fed to an oil tank 64 via an oil cooler 62 together with oil discharged from the main scavenging pump 52 and the sub-scavenging pump 53.

This structure allows the main scavenging pump 52 and the sub-scavenging pump 53 to reliably draw the oil from the reservoirs 57, 58. Additionally, this arrangement provides more freedom in the design of the bottom portion of the crank case 60 and thus it is easier to lower the center of gravity of vehicle while keeping a sufficient ground clearance relative to the crank case 60 (see e.g. Japanese Laid-open Patent Publication No. 73731/2001).

Recently, however, it has become more desirable to further lower the center of gravity in vehicles such as all-terrain vehicles and water-vehicles, while maintaining sufficient ground clearance relative to the crank case. In the lubricating apparatus of the prior art noted above in which three pumps 51, 52 and 53 are arranged within the crank case 60 of engine, the capacity of the oil reservoir and the oil tank is reduced due to the pumps and partition walls. This problem is more severe in multi-cylinder engines, in that it is more difficult to draw oil from each of the oil reservoirs 57 and 58 in a stable manner while the position of vehicle changes, due to additional limitations in layout in the multi-cylinder engine.

SUMMARY OF THE INVENTION

It is, therefore, an object of the present inventions to provide a lubricating apparatus for an internal combustion engine which can solve the problems of the prior art and stably carry out lubrication wherein oil is more consistently drawn from each of the oil reservoirs during movement of the vehicle, the oil passages are simplified, while oil agitation and oil temperature is suppressed.

Thus, in accordance with one embodiment, a lubricating apparatus for an internal combustion engine comprises a feed pump configured to feed lubricating oil from an oil tank to portions of the engine to be lubricated, and at least first and second scavenging pumps configured to return the lubricating oil accumulated in an oil reservoir of the engine to the oil tank. The oil reservoir is separated into at least first and second partitioned reservoirs. The first and second scavenging pumps are configured to draw oil from the first and second partitioned reservoirs, respectively. The feed pump and the first and second scavenging pumps are formed by a plurality of rotors arranged on one pump shaft and are parallel with each other and forming an oil pump unit. The oil tank and the oil pump unit are arranged on an outside of the internal combustion engine. The pump shaft is arranged in a same direction as that of a crank shaft of the engine.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENT

One preferred embodiment of a lubricating apparatus for an internal combustion engine of the present invention is described below with reference to drawings showing an example thereof applied to a water vehicle. The embodiments disclosed herein are described in the context of a water vehicle because these embodiments have particular utility in this context. However, the embodiments and inventions herein can also be applied to other marine vessels, such as small jet boats, stern drive inboard/outboard boats, as well as other land vehicles including off-road vehicles such as all-terrain vehicles, motorcycles, dune-buggies, snowmobiles, or any vehicle in which it is desirable to have a larger ground clearance and/or a lower center of gravity.

Figure 1:
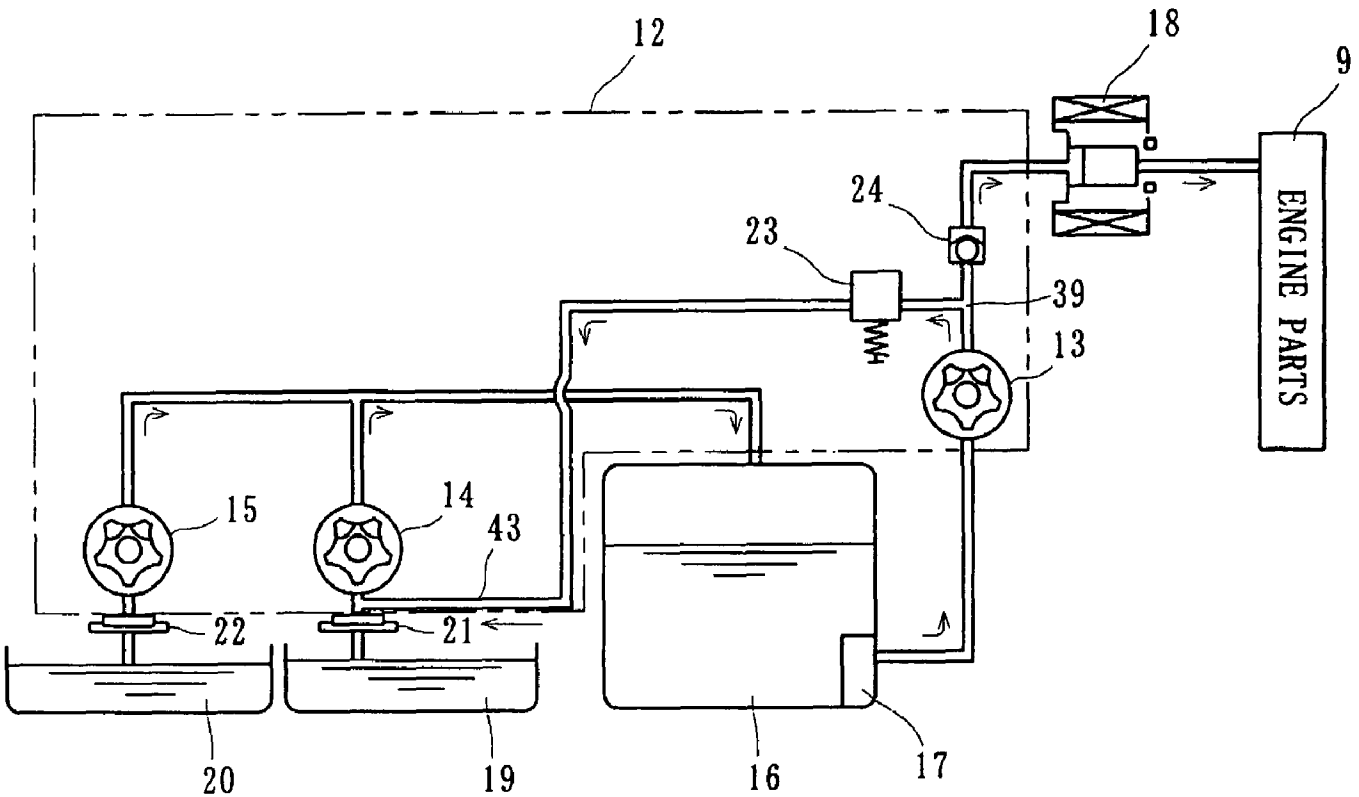
FIG. 1 is a schematic view of a lubricating apparatus for an internal combustion engine according to one embodiment.
Figure 2:
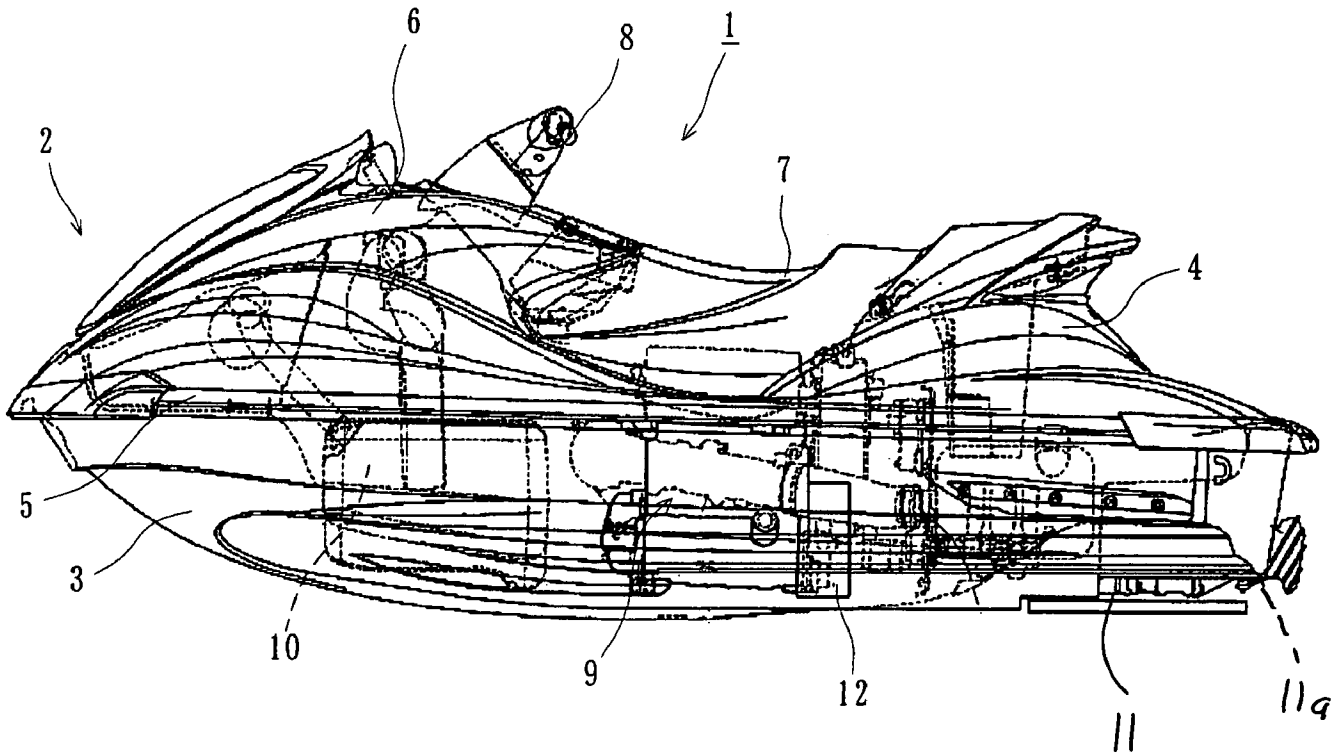
FIG. 2 is a side elevation view of a water-vehicle to which the lubricating apparatus of FIG. 1 is applied.
Figure 3:
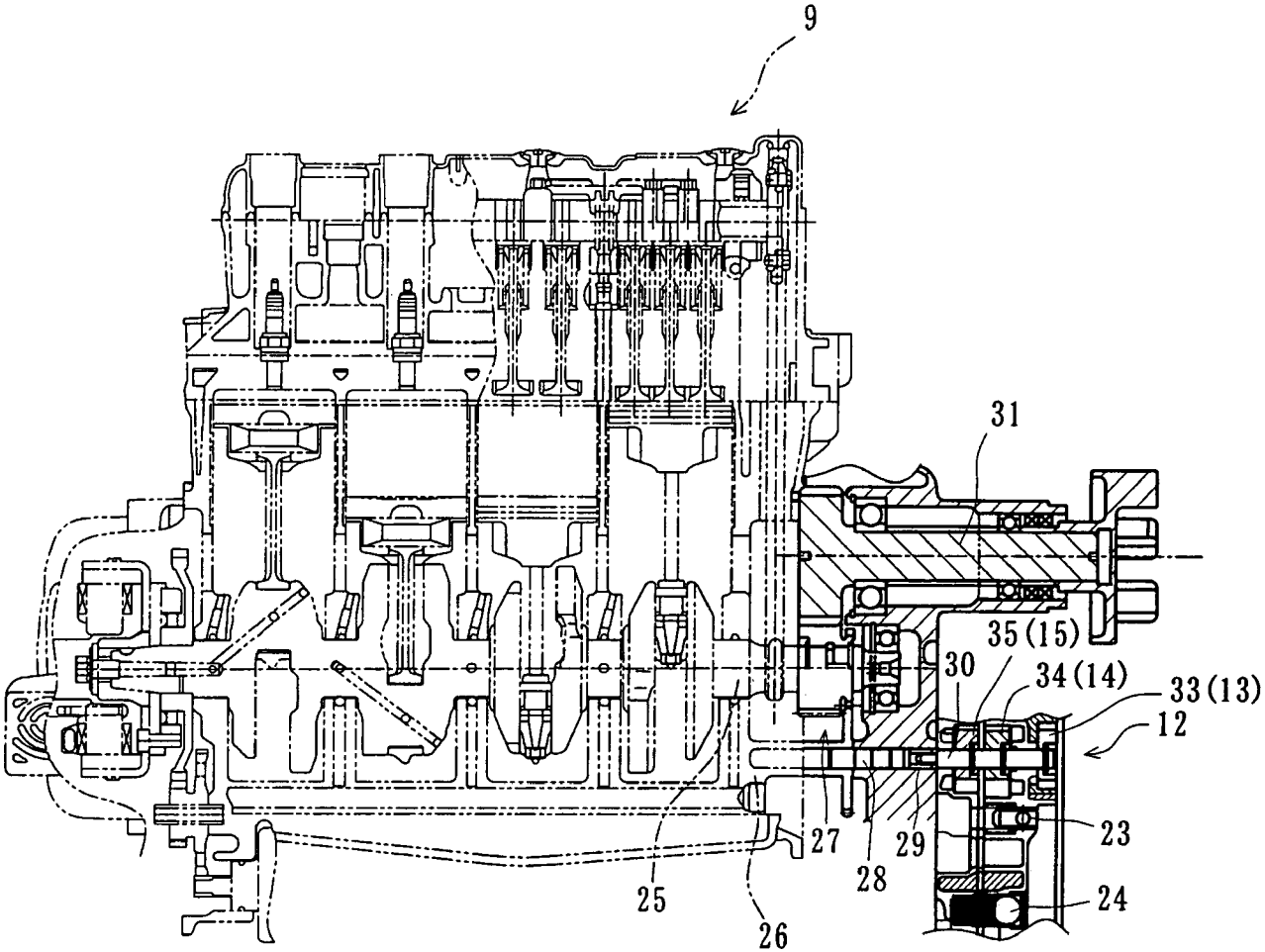
FIG. 3 is a cross-sectional side elevation view of the internal combustion engine within the watercraft of FIG. 2 and including an oil pump.
Figure 4:
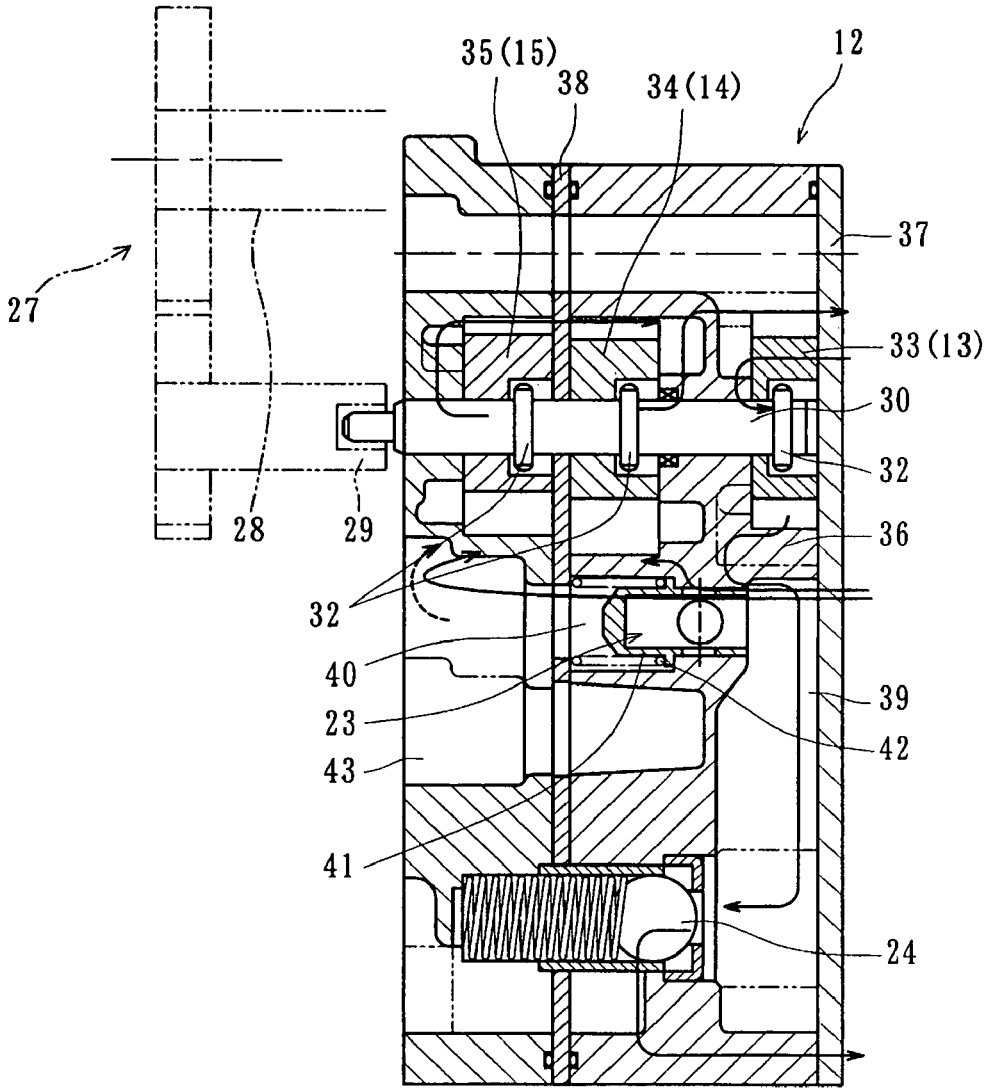
FIG. 4 is an enlarged cross-sectional view of the oil pump of FIG. 3.

FIG. 1 is a schematic view of a lubricating apparatus in accordance with one embodiment; FIG. 2 is a side elevation view of a water-vehicle to which the lubricating apparatus of FIG. 1 is applied; FIG. 3 is a cross-sectional side elevation view of the internal combustion engine including the oil pump in accordance with one embodiment; and FIG. 4 is an enlarged cross-sectional view of the oil pump of FIG. 3.

Initially, a general structure of the water-vehicle shown is described below with reference to FIG. 2. A body 2 of the water-vehicle 1 has a structure in which a bath tub-shaped hull 3 and a lid shaped deck 4 are connected with each other in water tight configuration at gunnels 5. A hatch cover 6 is mounted on the body 2 at a front portion of the deck 4 so as to be moveable between open and closed positions.

A saddle-type seat 7 is detachably mounted on the upper central portion of the deck 4 and a steering handle 8 is also mounted on the front side of the seat 7. An internal combustion engine 9 is arranged under the seat 7. A fuel tank 10 is also arranged below the hatch cover 6. A propelling unit 11 is arranged on a rear side of the engine 9. The propelling unit 11 can generate the propelling force by drawing water via a spinning impeller and by jetting the water from jetting nozzles 11*a* rearwardly. The impeller is connected to an output shaft (not shown) of the engine 9 by one or a plurality of shafts. An oil pump 12, described below, is arranged proximate to a lower portion of the engine 9 and on a rear side thereof.

Other positions for the oil pump 12 can also be used. For example, the oil pump 12 can be disposed on a front side of the engine 9, and other positions. In the illustrated embodiment, the pump 12 is part of a drysump-type lubricating system for the engine 9.

With reference to FIG. 1, the oil pump 12 is arranged at the outside of the engine 9 and comprises at least one feed pump 13 and can have two scavenging pumps 14 and 15. The feed pump 13 can draws the oil from an oil tank 16 through a strainer 17, so as to filter out foreign particles. In this embodiment, the feed pump 13 discharges the oil to an oil filter 18. The oil flowed from the oil filter 18 is fed to various parts of engine 9 to be lubricated. The lubrication of the components of internal combustion engines is well known in the art and is not discussed further.

After being circulated through the engine 9 for lubrication, the oil drops into oil reservoirs 19 and 20 arranged at the bottom of a crank case (not shown) and is collected therein. The oil collected in these oil reservoirs 19 and 20 can be drawn in by the scavenging pumps 14 and 15 through strainers 21 and 22 and then discharged to an oil tank 16 arranged at the outside of the engine 9. The oil tank 16 can include a self-contained an oil cooler (not shown).

A relief valve 23 is arranged between a passage 39 of the discharge side of the feed pump 13 and a passage 43 of the intake side of the first scavenging pump 14. The relief valve 23 is configured to relieve pressure in the passage 39 of the discharge side of the feed pump 13 when the pressure exceeds a predetermined pressure. The surplus oil is fed to the oil tank 16, together with the discharged oil from the first scavenging pump 14. A check valve 24 is arranged in the passage 39 of the discharge side of the feed pump 13 to prevent back flow of oil from engine 9 when the engine 9 is stopped.

The power input and the structure of the oil pump 12 is described with reference to FIGS. 3 and 4. The engine 9 is a four cylinder engine of a longitudinal arrangement in which a crank shaft 25 of engine extends in a fore and aft direction of the body 2 of the water-vehicle. However, this is merely one type of engine with which the present inventions can be used. Those of skill in the art can readily appreciate that the present inventions can be used with many other types of engines.

In this embodiment, the rotation of the crank shaft 25 is transmitted, via a gear mechanism 27, to an idle shaft 28 arranged in parallel with the crank shaft 25. The rotation of the idle shaft is further transmitted to a pump shaft 30 via a dog mechanism 29. The rotation of the crank shaft 25 is also transmitted to an output shaft 31 via the gear mechanism 27 and drives the impeller shaft(s) (not shown) described above.

The oil pump 12 is arranged at the outside of the crank case 26. The feed pump 13 and the scavenging pumps 14 and 15 are driven together by the pump shaft 30.

As shown in FIG. 4, rotors 33, 34 and 35 respectively of the feed pump 13, first scavenging pump 14 and the second scavenging pump 15 are arranged on the same pump shaft 30 and secured thereto via pins 32 so as to be rotated together. These rotors 33, 34 and 35 are rotatably arranged within separate pumping chambers formed. The pumping chambers can be formed in a single housing 36. In an exemplary embodiment, the housing 36 can be made from die cast aluminum alloy and the partition walls 37 and/or separating walls 38 can be formed by plates of aluminum alloy. These separate pumping chambers constitute the feed pump 13, the first scavenging pump 14 and the second scavenging pump 15.

By arranging partition walls 37 and separating walls 38 formed by plates of aluminum alloy into a housing 36 of aluminum alloy die casting, it is possible to simplify the structure of the housing 36 of the oil pump 12 and to use a single housing 36 to house these various types of oil pumps and thus to reduce the manufacturing cost.

With continued reference to FIG. 4, the first scavenging pump 14 is adapted to return the oil collected in the oil reservoir 19 and the surplus oil flowed into the oil reservoir 19 via the relief valve 23 to the oil tank 16 as shown by the arrows in FIG. 4. The feed pump 13 is adapted to draw oil from the oil tank 16 and then feed it to the oil filter 18 via the check valve 24 as shown by arrows. The oil reservoirs 19 and 20 respectively of the first and second scavenging pumps 14 and 15 are arranged in the fore and aft direction of water-vehicle body so that the oil can easily collected into the oil reservoirs 19 and 20 even when the vehicle body is inclined in the fore and aft direction.

A relief chamber 40 communicates with the passage 39 of the discharge side of the feed pump 13. The relief valve 23 is configured to be slidable in a direction generally parallel to the pump shaft 30. The relief valve 23 has a valve element 41 that can be cup-shaped and which can slide to open and close the relief chamber 40. The valve element 41 is biased toward a closed position by a spring 42, to thereby close the relief chamber 40. When the pressure in the passage 39 of the discharge side of the feed pump 13 exceeds a predetermined threshold, it overcomes the force of the spring 42 and displaces the valve element 41 toward the left (as viewed in FIG. 4). Accordingly, the relief chamber 40 of the relief valve 23 communicates with the passage 43 of the intake side of the first scavenging pump 14. As such, the oil in the passage 39 of the discharge side of the feed pump 13 is allowed to flow into the passage 43 of the intake side of the first scavenging pump 14. This prevents the oil in the passage 39 of the discharge side of the feed pump 13 from exceeding the predetermined value.

Figure 5:
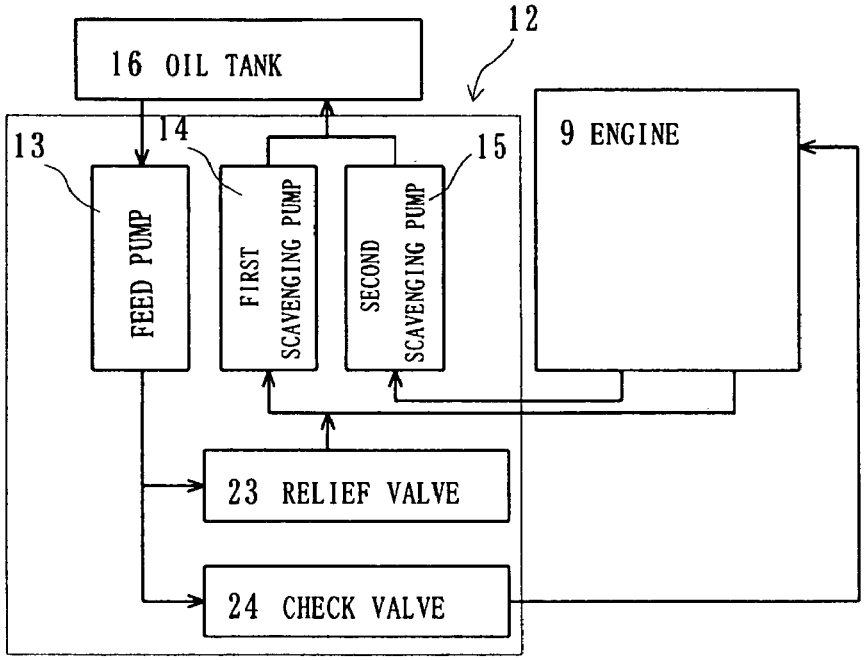
FIG. 5 is a block diagram schematically illustrating flows of lubricating oil in the lubricating apparatus.

With reference to FIG. 5, the second scavenging pump 15, the first scavenging pump 14 and the feed pump 13 can be arranged in this order axially from the internal combustion engine 9. During operation, the oil used in the engine 9 is collected in the oil reservoirs 19 and 20, respectively. The oil is then drawn in by the scavenging pumps 14 and 15 and returned to the oil tank 16. The oil in the oil tank 16 is drawn in by the feed pump 13 and fed again by pressure to the engine 9 via the check valve 24.

When a pressure in the passage 39 of the discharge side of the feed pump 13 exceeds a predetermined relief pressure, the relief valve 23 opens to relieve the surplus oil which is then returned to the oil tank 16 together with the discharged oil from the first scavenging pump 14.

Figure 6:
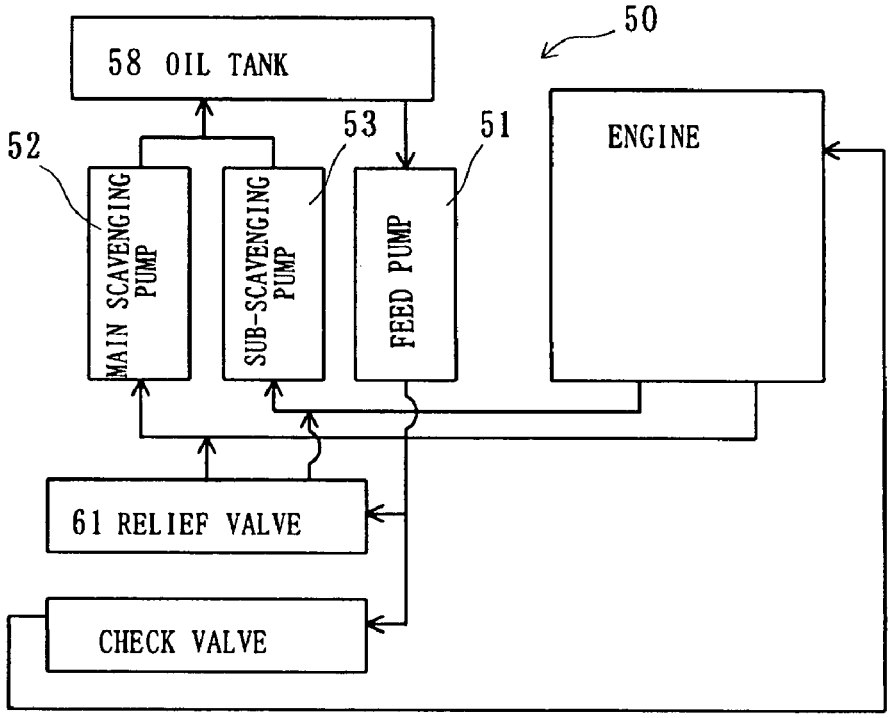
FIG. 6 is a block diagram schematically illustrating flows of lubricating oil in the lubricating apparatus of the prior art.
Figure 7:
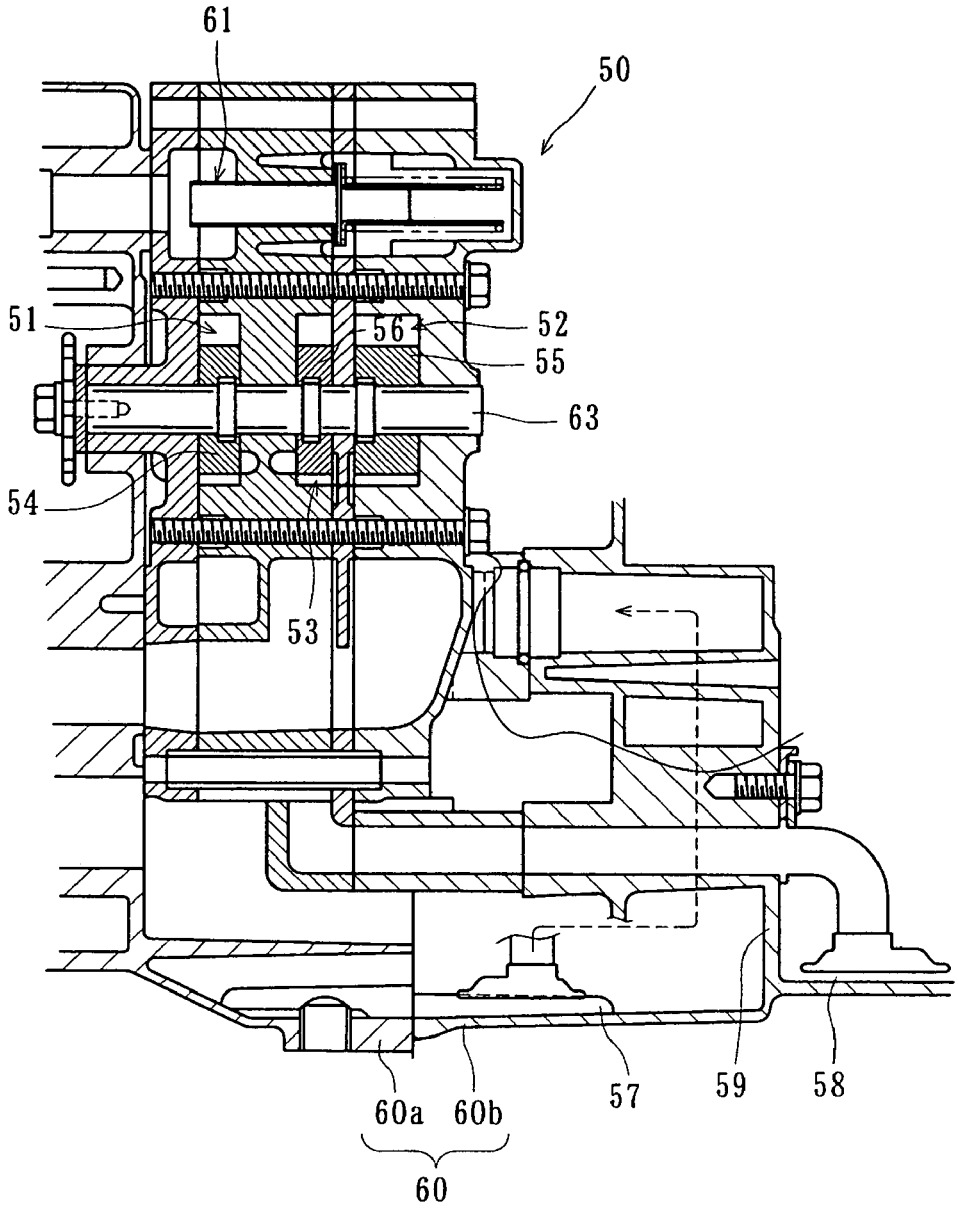
FIG. 7 is a cross-sectional view showing an oil pump and an oil passage structure of the prior art.
Figure 8:
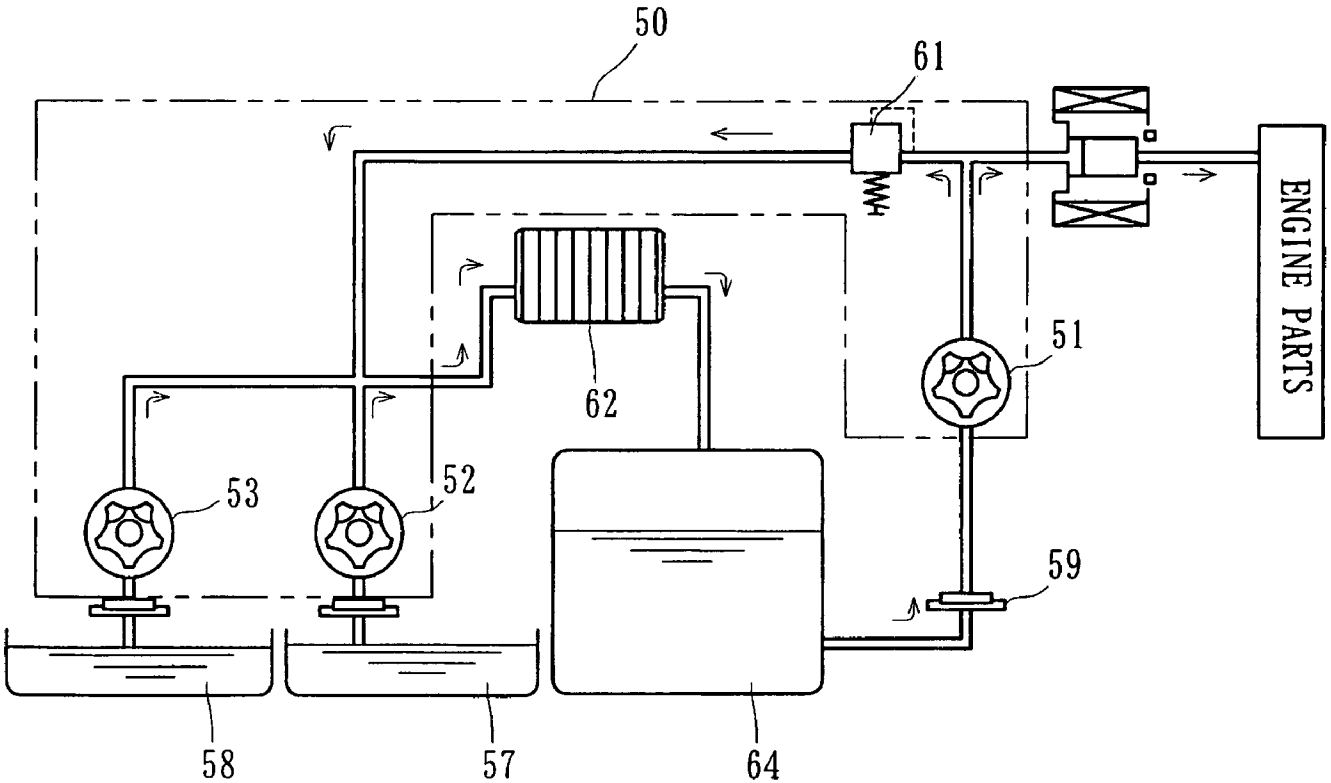
FIG. 8 is a schematic diagram showing a lubricating apparatus for an internal combustion engine of the prior art.

Flows of the lubricating oil in an oil pump of the prior art are shown in FIG. 6. In the oil pump unit 50 which is contained in an engine, the feed pump 51, the sub-scavenging pump 53 and the main scavenging pump 52 are arranged in this order axially. The oil used in the engine is collected in the oil reservoirs 57 and 58, and is then drawn in by the scavenging pumps 52 and 53 and returned to the oil tank 58. The oil in the oil tank 58 is drawn in by the feed pump 51 and fed again to the engine via the check valve (not shown). When an oil pressure in the passage of the discharge side of the feed pump 51 exceeds a predetermined relief pressure, the relief valve 61 is opens to relieve the surplus oil which is then returned to the oil tank 58 together with the discharged oil from the main scavenging pump 52 and the sub-scavenging pump 53.

Since the oil pump 12 of the present invention is arranged at the outside of the engine 9, the pump 12 does not occupy space within the engine 9. Rather, this arrangement provides more design freedom with regard to the (volume) and layout of the oil reservoirs as compared with the oil pump 50 of the prior art in which three pumps 51, 52 and 53 are arranged within the crank case of the engine. As can be seen from comparison of FIG. 5 and FIG. 6, it is possible, according to the present embodiments, to provide a lubricating apparatus for an internal combustion engine in which the oil passages are shortened and simplified, while the loss of oil through agitation is reduced and a rise in oil temperature rise is suppressed. In addition, it is possible to reduce the axial dimension of the oil pump and to keep the axial space of the check valve 24 by arranging the feed pump 13 at a place farthest from the engine 9.

The present inventions have been described with reference to the preferred embodiments. Obviously, modifications and alternations will occur to those of ordinary skill in the art upon reading and understanding the preceding detailed description. It is intended that the present inventions be construed as including all such alternations and modifications insofar as they come within the scope of the appended claims or the equivalents thereof.

What is claimed is:

1. A lubricating apparatus for an internal combustion engine comprising a feed pump configured to feed lubricating oil from an oil tank to portions of the engine to be lubricated, and at least first and second scavenging pumps configured to return the lubricating oil accumulated in an oil reservoir of the engine to the oil tank, the oil reservoir being separated into at least first and second partitioned reservoirs, the first and second scavenging pumps configured to draw oil from the first and second partitioned reservoirs, respectively, the feed pump and the first and second scavenging pumps being formed by a plurality of rotors arranged on one pump shaft and being parallel with each other and forming an oil pump unit, wherein the oil tank and the oil pump unit are arranged on an outside of the internal combustion engine, and wherein the pump shaft is arranged in a same direction as that of a crank shaft of the engine.

2. A lubricating apparatus for an internal combustion engine according to claim 1, wherein the feed pump and the first and second scavenging pumps are arranged in serial order along a direction extending away from the engine, the feed pump being disposed farthest from the engine, a check valve is arranged in a passage of the discharge side of the feed pump, and a relief valve is arranged between a passage of the discharge side of the feed pump and the scavenging pumps.

3. A lubricating apparatus for an internal combustion engine according to claim 2, wherein a relief valve is arranged between a passage of the discharge side of the feed pump and a passage of the intake side of the first and second scavenging pumps.

4. A lubricating apparatus for an internal combustion engine according to claim 1, wherein the oil pump unit comprises a die cast aluminum alloy housing and a plurality of walls defining individually independent pumping chambers, the walls being formed by plates of aluminum alloy.

5. A lubricating apparatus for an internal combustion engine according to claim 2, wherein the oil pump unit comprises a die cast aluminum alloy housing and a plurality of walls defining individually independent pumping chambers, the walls being formed by plates of aluminum alloy.

6. A lubricating apparatus for an internal combustion engine according to claim 3, wherein the oil pump unit comprises a die cast aluminum alloy housing and a plurality of walls defining individually independent pumping chambers, the walls being formed by plates of aluminum alloy.

* * * * *